US007427170B2

(12) United States Patent
Van Buskirk et al.

(10) Patent No.: US 7,427,170 B2
(45) **Date of Patent: *Sep. 23, 2008**

(54) METHOD AND DEVICE FOR DELIVERY AND CONFINEMENT OF SURFACE CLEANING COMPOSITION

(75) Inventors: Gregory Van Buskirk, Oakland, CA (US); Martha Adair, Oakland, CA (US); Cristina Gancedo, deceased, late of Oakland CA (US); by Susana M. Nazario, legal representative, Castro Valley, CA (US); Mel Salwasser, Oakland, CA (US)

(73) Assignee: The Clorox Company, Oakland, CA (US)

( * ) Notice: Subject to any disclaimer, the term of this patent is extended or adjusted under 35 U.S.C. 154(b) by 472 days.

This patent is subject to a terminal disclaimer.

(21) Appl. No.: 11/136,101

(22) Filed: May 23, 2005

(65) Prior Publication Data

US 2005/0251944 A1 Nov. 17, 2005

Related U.S. Application Data

(63) Continuation-in-part of application No. 10/410,808, filed on Apr. 9, 2003, now Pat. No. 6,905,276.

(51) Int. Cl.
*B43K 1/06* (2006.01)
*B43K 23/12* (2006.01)
*B43M 11/06* (2006.01)

(52) U.S. Cl. ..... 401/265; 401/262; 401/183; 401/268; 252/187.24; 252/187.27

(58) Field of Classification Search ..... 401/261–265, 401/183–186, 268, 270; 252/186.1, 187.23, 252/187.24, 187.25, 187.26, 187.27
See application file for complete search history.

(56) References Cited

U.S. PATENT DOCUMENTS 62,523 A 3/1867 Bonney (Continued)

FOREIGN PATENT DOCUMENTS

DE 19536714 9/1995

(Continued)

*Primary Examiner*—David J Walczak
(74) *Attorney, Agent, or Firm*—David Peterson

(57) ABSTRACT

A device for applying a thickened cleaning composition to a selected surface area that minimizes or eliminates any unintentional or excess application of the composition and/or minimizes or eliminates any spreading or wicking of the composition beyond the selected surface area after application. A dispensing device featuring the combination of a thickened cleaning composition having a specified rheology and a dispenser with one or more orifices of preferred cross-sectional area that enable convenient application of a cleaning composition to the selected region of a soft or hard surface. Additionally, the dispensing device features cleaning compositions having preferred wicking rates with respect to the treated surfaces so that only the selected stained or soiled region of the surface is effectively treated, as the cleaning compositions will not spread or wick into adjacent regions of the surface where damage may occur.

15 Claims, 2 Drawing Sheets

U.S. PATENT DOCUMENTS

| | | | | |
|---|---|---|---|---|
| 1,586,769 | A | 6/1926 | Askin | |
| 4,259,201 | A | 3/1981 | Cockrell, Jr. et al. | 252/103 |
| 4,473,507 | A | 9/1984 | Bossu | 260/502 |
| 4,790,856 | A | 12/1988 | Wixon | 8/137 |
| 4,818,425 | A | 4/1989 | Meijer et al. | 252/94 |
| 4,900,467 | A | 2/1990 | Smith | 252/95 |
| 4,986,926 | A | 1/1991 | Hoffman | 252/102 |
| 5,055,219 | A | 10/1991 | Smith | 252/102 |
| 5,279,758 | A | 1/1994 | Choy | 252/104 |
| 5,297,883 | A | 3/1994 | Ozu | 401/202 |
| 5,324,131 | A | 6/1994 | Gardner, III | 401/199 |
| 5,389,157 | A | 2/1995 | Smith | 134/22.13 |
| 5,731,276 | A | 3/1998 | Argo et al. | 510/284 |
| 5,741,437 | A | 4/1998 | Arbogast et al. | 252/186.39 |
| 5,813,787 | A | 9/1998 | Dowzall et al. | 401/199 |
| 5,843,190 | A | 12/1998 | Agostini et al. | 8/108.1 |
| 5,909,978 | A | 6/1999 | Giordano et al. | 401/188 |
| 5,915,872 | A | 6/1999 | Machida et al. | 401/251 |
| 5,964,226 | A | 10/1999 | Sobel | 132/108 |
| 5,967,686 | A | 10/1999 | Melnick | 401/195 |
| 6,010,994 | A | 1/2000 | Choy et al. | 510/312 |
| 6,046,150 | A | 4/2000 | Choy et al. | 510/376 |
| 6,083,422 | A | 7/2000 | Ambuter et al. | |
| 6,086,276 | A | 7/2000 | Gueret | 401/54 |
| 6,152,634 | A | 11/2000 | Kim | 401/195 |
| 6,161,975 | A | 12/2000 | Clarke | 401/34 |
| 6,209,548 | B1 | 4/2001 | Harrison et al. | 132/74.5 |
| 6,231,257 | B1 | 5/2001 | Stevens | 401/108 |
| 6,283,660 | B1 | 9/2001 | Furlong et al. | 401/135 |
| 6,309,127 | B1 | 10/2001 | Salemme | 401/213 |
| 6,310,025 | B1 | 10/2001 | Del Duca et al. | 510/283 |
| 6,386,781 | B1 | 5/2002 | Gueret | 401/198 |
| 6,402,412 | B2 | 6/2002 | Sukhna et al. | 401/198 |
| 6,551,000 | B2 | 4/2003 | Kandasamy et al. | |
| 2001/0019682 | A1 | 9/2001 | Sukhna et al. | 401/198 |
| 2002/0039511 | A1 | 4/2002 | Park | 401/107 |
| 2002/0054783 | A1 | 5/2002 | Gueret | 401/202 |
| 2002/0071708 | A1 | 6/2002 | Fontanet et al. | 401/202 |
| 2002/0090251 | A1 | 7/2002 | Sandbach et al. | 401/198 |

FOREIGN PATENT DOCUMENTS

| | | |
|---|---|---|
| EP | 1068835 | 7/1999 |
| EP | 1069179 | 7/1999 |
| EP | 1069180 | 7/1999 |
| EP | 0624154 | 9/1999 |
| EP | 1069177 | 6/2000 |
| EP | 1069178 | 6/2000 |
| GB | 2143231 | 2/1984 |
| JP | 09-286200 | 4/1997 |
| WO | WO 01/04259 | 1/2001 |
| WO | WO 01/04260 | 1/2001 |
| WO | WO 01/04261 | 1/2001 |
| WO | WO 02/079370 | 10/2002 |

METHOD AND DEVICE FOR DELIVERY AND CONFINEMENT OF SURFACE CLEANING COMPOSITION

CROSS REFERENCE TO RELATED APPLICATION

The present application is a continuation-in-part of application Ser. No. 10/410,808 to van Buskirk et al., which was filed Apr. 9, 2003, now U.S. Pat. No. 6,905,276 entitled "Method and device for delivery and confinement of surface cleaning composition", and incorporated herein.

FIELD OF THE INVENTION

The present field of the invention relates to a device for controllably delivering a thickened cleaning composition for precise and targeted application to a soiled surface.

BACKGROUND OF THE INVENTION

Consumers have long struggled with how to spot treat substrates, such as fabrics or hard surfaces, with cleaning compositions, in particularly those containing potentially damaging cleaning components such as oxidants, including liquid bleach compositions. One method consumers use in order to clean small areas with liquid bleach is to dip a cotton-tipped swab into the bleach and then treat that area using the cotton-tipped swab to control where bleach is applied. This method is somewhat messy regarding ease in wetting a cotton-tipped swab using a large bottle of bleach and does not enable a consumer to precisely apply the bleach where desired. Other issues occur with this method. Excess bleach has the potential to drip from the cotton-tipped swab onto other surfaces, which may be damaged by contact with the cleaning composition. If used to treat fabric, current commercial fabric bleaches will spread and wick into the fabric indiscriminately, bleaching adjacent areas not intended, such as with fabrics having both white and colored areas, which cannot be washed using a laundry bleach to remove stains, even if those stains are confined to a potentially bleachable portion of the fabric. For hard surfaces, application is generally in areas that are hard to reach without a small applicator and yet require applying a cleaning composition directly onto the stained or soiled area. One example is stained grout located in a corner of a shower stall next to wallpaper or a painted surface, or a stained tile next to a metal faucet, where the adjacent surfaces may be damaged or discolored by the cleaning composition. Clearly what is needed is a means to selectively apply a cleaning composition, both accurately and precisely to a selected area to effect treatment, without concern that such treatment will spread or wick into unintended areas. Prior art in this field includes the following documents:

DE 195 36714 discloses a clothing spot cleaning stick and covers the basic design and use of a personal cleaning pen. WO 01/04260 discloses a felt tip pen-like applicator with a nib. The disadvantages and limited use of this device stems from the need to use bleaching fluids of relatively high viscosity, which have a tendency to clog, thereby affecting the user's ability to precisely control the delivery of the bleaching fluid. U.S. Pat. No. 6,386,781 B1 also discloses an applicator for packaging and applying a liquid product that requires an axially movable block of absorbent material that is saturated in the composition when the product is not in use.

WO 01/04259 discloses a stain removal pen that requires the fabric treatment composition to be left to evaporate. However, the disadvantage of this invention is that it also requires sufficient mechanical performance so as to induce a certain frictional stress upon the fabric. The frictional stress required in the invention has to be high enough as to ensure good mechanical stain removal and good delivery of the fabric treatment composition. As a consequence this invention cannot be used in situations that require accurate and precise application of the cleaning composition because the use of a mechanical step promotes the wicking or spreading of the composition.

WO 01/04261 discloses a stain removal pen and method of stain removal for garments worn on the body. However the invention requires heating the fabric treatment composition in the range of that provided by direct or indirect body heat to be effective.

SUMMARY OF THE INVENTION

The invention is a device and means for applying a cleaning composition to a selected surface area that minimizes or eliminates any unintentional or excess application of the composition and/or minimizes or eliminates any spreading or wicking of the composition beyond the selected surface area after application. In a preferred embodiment of the current invention, the composition contains an oxidant or bleaching component that precisely delivers and confines the area of the bleaching action only to the portion of the treated fabric as defined by the user when they apply the composition.

The invention is used to spot treat stains or soils on both soft surfaces and hard surfaces. The combination of a thickened cleaning composition of specified rheology and a preferred orifice cross-section area enables only the intended stain or soil on a soft surface, such as fabric, to be treated, and further provides a composition that will not spread or wick into areas of the fabric where damage may occur, such as colored fabric areas adjacent to a soiled white fabric. Additionally, preferred compositions for use in the dispensing device exhibit optimal wicking rates with respect to the selected soft surface, such that spreading or wicking of the compositions into surrounding areas of the soft surface is minimized or eliminated. For hard surfaces, this invention will deliver product only to the stained or soiled area. For example, the combination of a thickened cleaning composition and a preferred orifice size enables targeting only the soiled grout or caulk line and not the tile, metal fixture or painted surfaces next to the line to be treated, thus preventing potential damage. In a preferred embodiment of the invention, the invention is a convenient stain removal applicator that features a thickened bleach composition delivered via a dispensing means with small orifices for precise and targeted application to a soiled surface. Additionally, preferred compositions for use in the dispensing device also exhibit optimal wicking rates with respect to the hard surface, such that spreading of the compositions into surrounding areas is minimized or eliminated.

DETAILED DESCRIPTION OF THE INVENTION

Figure 1:
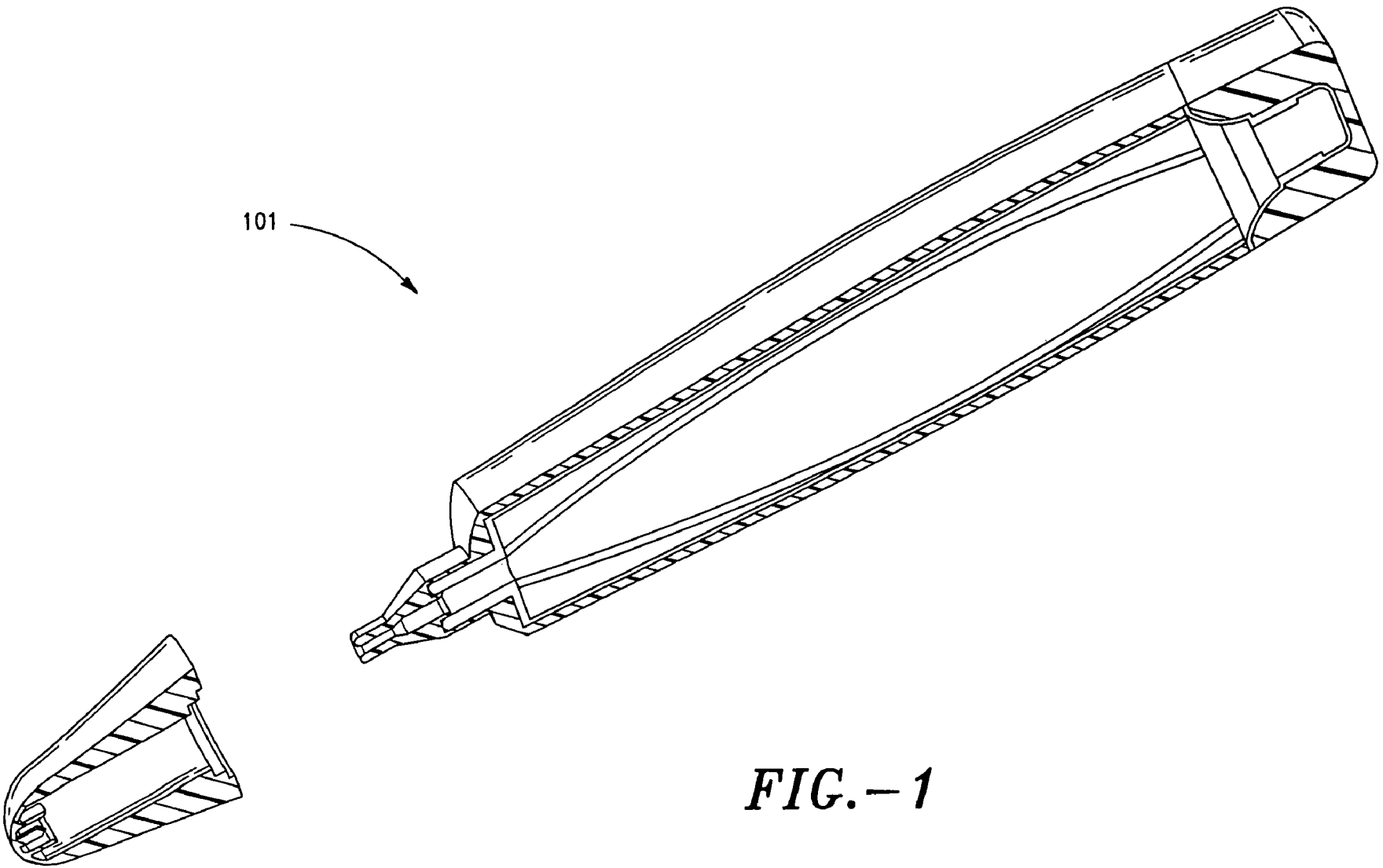
FIG. 1 is a cross-sectional view of an applicator 101 and an overcap with a clearing pin according to the present invention.
Figure 2:
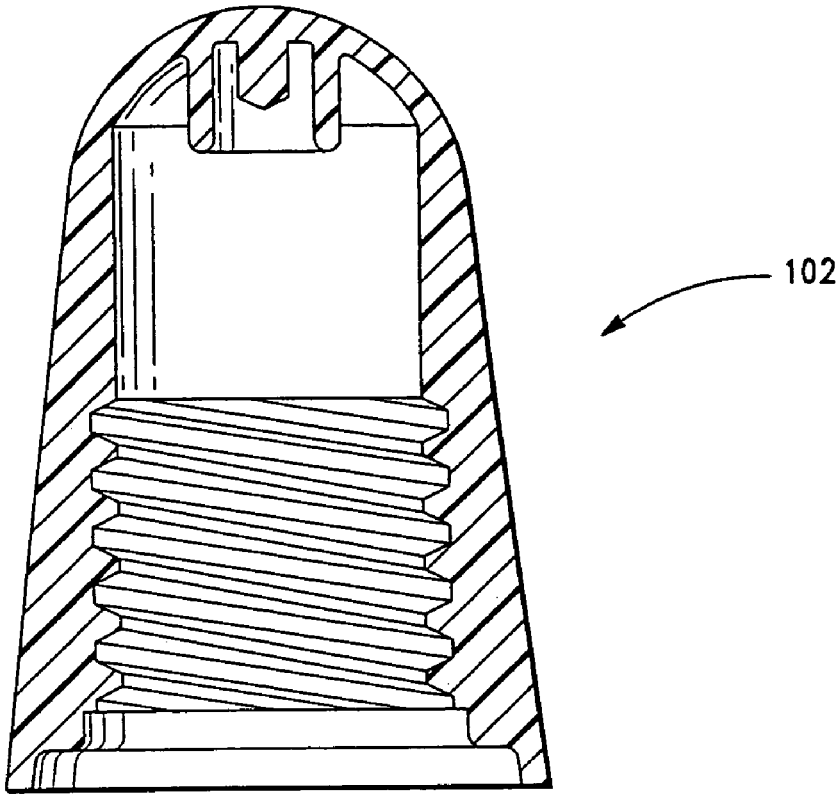
FIG. 2 is a cross-sectional view of an alternative overcap 102 with a clearing pin according to the present invention.
Figure 3:
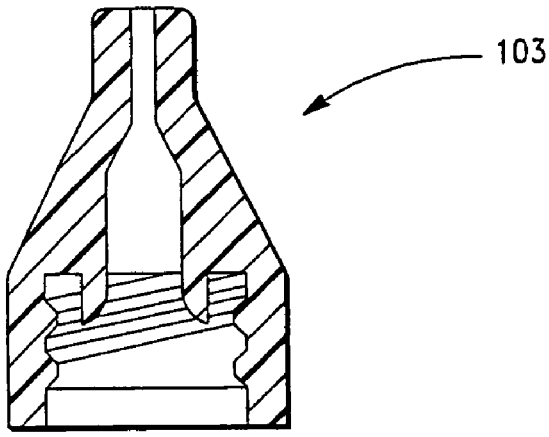
FIG. 3 is a cross-sectional view of an alternative tip 103 to the applicator according to the present invention.

The invention relates to a device and method for delivering a thickened cleaning composition for precise and targeted application to a soiled surface.

The current invention enables treatment of multiple substrates whereby application is limited to an effective treatment area on the surface to be treated. This is advantageous in enabling application of the thickened cleaning compositions to a desired area, in a controlled amount, with properties inherent to the compositions that prevent excessive and undesirable spreading (for hard or non-porous surface substrates) and/or wicking (for soft or porous surface substrates) away from the desired treatment area into surrounding areas that could be potentially damaged by the inventive compositions. This precise control is achieved in the inventive system by advantageously combining thickened cleaning compositions having suitable viscosities and wicking/spreading rates with an applicator having an applicator means comprising at least one orifice with a cross-sectional area below a critical cross-sectional area. Multiple orifices may be employed, wherein each orifice has a cross-sectional area below the critical cross-sectional area, in order to provide the application means with an increased effective treatment area while maintaining the advantageous controlled dispensing that the combination of the suitably thickened cleaning compositions in combination with one or more orifices with cross-sectional areas below the critical cross-sectional area individually provide.

An example for a hard surface usage is application of a thickened bleach composition using the applicator to a soiled grout line in proximity to a painted wall junction or metal fitting. The novel combination of selected viscosities and applicator orifice size enables controlled delivery of the inventive bleach compositions to the effective treatment area without significant migration or flow of the composition outside of the effective treatment area. The inventive thickened cleaning compositions have viscosities sufficiently low to enable smooth and controlled dispensing through the delivery orifice when subjected to applied hand and/or finger pressure to the dispensing applicator by the user, yet have viscosities sufficiently large to provide the necessary rheological properties to resist undesirable spreading or sagging (if applied to a vertical surface area) once the composition has been deposited within the desired treatment area. Suitable viscosities range from 1000 cP (centipoise) to about 50,000 cP, and preferably from 5,000 cP to about 50,000 cP, and most preferably from 7,500 cP to about 50,000 cP.

Without being bound by theory, the inventive thickened cleaning compositions also exhibit some degree of shear-thinning behavior that enables them to thin slightly (i.e. undergo a temporary decrease in elastic flow properties) and flow through the dispensing orifice while under the influence of user applied pressure, yet regain their normal structure and at-rest viscosities immediately after having been dispensed, contributing to the tendency of the thickened cleaning composition to remain in the application area where it was applied.

An example for a soft or porous surface usage is application of a thickened bleach composition using the applicator to a stained spot on the white colored portion of a checkered textile with white and dark colored squares, wherein the dark colored squares would be damaged by direct contact with a bleach composition through mechanisms of excessive spreading or wicking if a non-inventive bleach product was applied adjacent to this area. With application of the inventive thickened bleach compositions using the applicator device, the inventive thickened bleach compositions may be precisely applied to the effective treatment area. Thickened bleach compositions with viscosities within the preferred viscosity range also exhibit preferred low wicking rates that effectively limit the inventive compositions from spreading into areas outside of the effective treatment area when applied to highly porous substrates, including woven materials, textiles and the like. Suitable wicking rates on a porous substrate range from 0 mm/min (millimeters/minute) to less than about 1.0 mm/min, preferably between 0 mm/min to about 0.75 mm/min. Suitable spreading rates on a porous non-textile substrate or non-porous substrate are preferably between 0 mm/min to less than about 1.0 mm/min and most preferably between 0 mm/min to about 0.5 mm/min.

Without being bound by theory, the inventive thickened cleaning compositions having desirable physical properties and viscosities within the preferred viscosity range, also advantageously exhibit sufficiently low wicking rates so as not to migrate outside of the effective treatment area, yet have sufficient wicking tendency to wet the surface area in immediate contact with the composition to enable penetration and cleaning action of the substrate where the thickened cleaning composition has been applied.

The invention encompasses selected thickened cleaning compositions for use with an applicator having a novel combination of viscosity within a suitable viscosity range, and wicking/spreading rates within a suitable wicking/spreading rate range that enable effective control of application of the inventive compositions and ensures confinement of the inventive compositions onto the target surfaces within the effective treatment area when applied with an applicator having at least one dispensing orifice with a cross-sectional area below a critical cross-sectional area. The unique combination of properties enables precise and targeted treatment using the inventive thickened composition on both hard and soft surfaces, even when these surfaces and substrates have widely different inherent porosities and wicking properties with respect to the inventive thickened compositions.

Unlike conventional application devices, the effective treatment area of the invention may be precisely controlled and enlarged by adding additional orifices to the applicator means, rather than by increasing the orifice size. In conventional application devices the increased orifice size enables more product to be dispensed, but necessarily lacks the ability to control the flow of the dispensed material. Typically, the dispensed material must be substantially thickened to retain flow control with larger orifices and such substantially thickened material than has insufficient wicking and spreading properties to effective treat the substrate to which it has been applied.

In contrast, the inventive combination, by optionally employing multiple, spaced orifices with preferred cross-sectional areas combined with selected viscosity and wicking properties of the inventive thickened cleaning compositions, enable precise treatment of a larger surface area with the benefits of flow control, precise targeting to the selected treatment area and controlled wicking/spreading as provided by a single orifice dispensing device. Suitable cross-sectional orifice areas are between 0.08 $mm^2$ to about 4 $mm^2$, preferably between 0.1 $mm^2$ to about 3 $mm^2$ and most preferably between 0.5 $mm^2$ to about 3 $mm^2$ with respect to internal cross-sectional area.

In a preferred embodiment of the invention, the applicator fits comfortably in the human hand, and in another preferred embodiment, has two independent applicator means for dispensing the inventive compositions for both small and medium application needs.

In a preferred embodiment of the invention, the applicator is hand powered by the user to effectively dispense the cleaning compositions from the device to the target surface solely by means of human applied finger, thumb and/or hand pressure. The combination of thickened compositions, thickened to within the preferred viscosity range of the invention, and one or more orifices comprising the dispensing means, each independently sized to within the optimal cross-sectional area range of the invention, enable precise and accurate dispensing of the composition, as well as ease of dispensing by application of pressure easily generated by the human hand. Preferably, the applicator is constructed in whole or in part using one or more materials with sufficient flexibility to respond to externally applied pressure in such a fashion as to communicate said pressure to the composition therein to effect discharge of the composition through the one or more orifices of the device.

Also envisioned is a device that may comprise two or more chambers to isolate incompatible ingredients, but which one may desire to deliver simultaneously to the area to be treated. The device may be so designed so as to deliver the two or more formulations through the same orifice, or through more than one orifice that may be situated in close or direct vicinity with respect to one another. Such multi-chambered executions may contain, but are not limited to, solutions which mutually boost performance, generate foam, generate heat, etc. The following examples in Table I are meant to illustrate, but not limit the scope of the invention:

TABLE I

| Desired Result | Example of an incompatible ingredient in Chamber 1 | Example of an incompatible ingredient in Chamber 2 |
|---|---|---|
| Foam generation | Sodium hypochlorite | Hydrogen peroxide |
| Heat generation | Sodium hypochlorite | Sodium thiosulfate |
| Improved bleaching efficacy | Hydrogen peroxide | Bleach activator |

The thickened cleaning compositions may contain thickening agents for optimum viscosity, and may optionally contain other performance enhancing agents, as well as other common adjuncts typically employed in cleaning compositions, including, but not limited to oxidants, stabilizers, surfactants, preservatives, pH adjustors, builders, chelators, dyes, fragrance and such.

Oxidizing Agents

Oxidizing agents that may be incorporated in the inventive composition are now described. In the present invention, the oxidizing agent is present in an amount ranging from 0.1 to 5 percent by weight of the composition. Generally the amount of oxidizing agent is preferably from about 0.5 to about 3.0 percent by weight of the composition and more preferably from about 1.0 to about 2.0 percent by weight of the composition.

According to the present invention, the oxidizing agent may be a peroxygen, or peroxide generating material, preformed organic peroxide or halogen-containing bleaching agent. Preferably, the oxidizing agent is a halogen bleach source which may be selected from various hypohalite-producing species, for example, bleaches selected from the group consisting of the alkali metal and alkaline earth salts of hypohalite, haloamines, haloimines, haloimides and haloamides. All of these are believed to produce hypohalous bleaching species in situ.

Preferably, the oxidizing agent is a hypohalite or a hypohalite generator capable of generating hypohalous bleaching species. Hereafter, the term "hypohalite" is used to describe either a hypohalite or a hypohalite generator, unless otherwise indicated. Preferably, the hypohalite oxidizing agent is a hypochlorite or a generator of hypochlorite in aqueous solution, although hypobromite or a hypobromite generator is also suitable. Representative hypochlorite generators include sodium, potassium, lithium, magnesium and calcium hypochlorite, chlorinated trisodium phosphate dodecahydrate, potassium and sodium dichloroisocyanurate and trichlorocyanuric acid. Organic bleach sources suitable for use include heterocyclic N-bromo and N-chloro imides such as trichlorocyanuric and tribromocyanuric acid, dibromocyanuric acid and dichlorocyanuric acid, and potassium and sodium salts thereof, N-brominated and N-chlorinated succinimide, malonimide, phthalimide and naphthalimide. Also suitable are hydantoins, such as dibromodimethylhydantoin and dichlorodimethylhydantoin, chlorodimethylhydantoin, N-chlorosulfamide (haloamide) and chloramine (haloamine).

Preferred chlorine releasing component for use herein is an alkali metal hypochlorite. Advantageously, the compositions of the invention are stable in presence of this bleaching component. Although alkali metal hypochlorites are preferred, other hypochlorite compounds may also be used herein and can be selected from calcium and magnesium hypochlorite. A preferred alkali metal hypochlorite for use herein is sodium hypochlorite.

The compositions of the present invention that comprise a peroxygen bleach may further comprise a bleach activator or mixtures thereof. By "bleach activator", it is meant herein a compound, which reacts with peroxygen bleach like hydrogen peroxide to form a peracid. The peracid thus formed constitutes the activated bleach. Suitable bleach activators to be used herein include those belonging to the class of esters, amides, imides, or anhydrides. Suitable examples of such compounds to be used herein are tetracetylethylenediamine (TAED), sodium 3,5,5 trimethylhexanoyloxybenzene sulphonate, diperoxydodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. A particular family of bleach activators also of interest was disclosed in U.S. Pat. Nos. 5,741,437, 6,010,994 and 6,046,150, generally described as n-alkyl alkyl ammonium acetonitrile activators, and particularly preferred in that family is n-methyl morpholinium acetonitrile (MMA).

The source of active oxygen according to the present invention acts as an oxidizing agent, it increases the ability of the compositions to remove colored stains and organic stains in general, to destroy malodorous molecules and to kill germs. Suitable sources of active oxygen are hydrogen peroxide or sources thereof. As used herein a hydrogen peroxide source refers to any compound, which produces hydrogen peroxide when said compound is in contact with water. Suitable water-soluble inorganic sources of hydrogen peroxide for use herein include persulfate salts (i.e., dipersulfate and monopersulfate salts), persulfuric acid, percarbonates, metal peroxides, perborates and persilicate salts.

In addition, other classes of peroxides can be used as an alternative to hydrogen peroxide and sources thereof or in combination with hydrogen peroxide and sources thereof. Suitable classes include dialkylperoxides, diacylperoxide, preformed percarboxylic acids, organic and inorganic peroxides and/or hydroperoxides. Suitable organic peroxides/hydroperoxides include diacyl and dialkyl peroxides/hydroperoxides such as dibenzoyl peroxide, t-butyl hydroperoxide, dilauroyl peroxide, dicumyl peroxide, and mixtures thereof. Suitable preformed peroxyacids for use in the compositions according to the present invention include diperoxydodecandioic acid (DPDDA), magnesium perphthalic acid, perlauric acid, perbenzoic acid, diperoxyazelaic acid and mixtures thereof. Persulfate salts, or mixtures thereof, are the preferred sources of active oxygen to be used in the compositions according to the present invention. Preferred persulfate salt to be used herein is the monopersulfate triple salt. One example of monopersulfate salt commercially available is potassium monopersulfate commercialized by Peroxide Chemie GMBH under the trade name CUROX®, by Degussa under the trade name CAROAT™ and from Du Pont under the trade name OXONE®. Other persulfate salts such as dipersulfate salts commercially available from Peroxide Chemie GMBH can be used in the compositions according to the present invention.

Thickening Agents

The thickening agent that is in the inventive composition is now described. The thickening agent may be selected from the class of materials and their mixtures, including, but not limited to, surfactants (which also impart cleaning performance), polymers, clays, and colloids.

In a preferred embodiment of the current invention, the thickening agent contributes to the viscous rheology of the composition. A viscous rheology, preferably one with an elastic component, most preferably a viscoelastic rheology, may be imparted to a single liquid, or to multiple liquids of the composition, preferably by a binary system including a betaine or sulfobetaine having a $C_{14-18}$ alkyl group, or a $C_{10-18}$ alkylamino or alkylamido group, and an anionic organic counterion that is thought to promote elongated micelles. Such systems are more fully described in U.S. Pat. Nos. 4,900,467 and 5,389,157 to Smith, and assigned to the assignee of the invention herein, the disclosures of which are incorporated herein by reference. Preferably the betaine is a $C_{14-18}$ alkyl betaine and the counterion is a $C_{2-6}$ alkyl carboxylate, aryl carboxylate, $C_{2-10}$ alkyl sulfonate, aryl sulfonate, sulfated aryl or $C_{2-10}$ alkyl alcohols, and mixtures thereof. Most preferably the counterion is an aryl sulfonate, e.g. sodium xylene sulfonate. The counterion may include substituents that are chemically stable with the active cleaning compound. Preferably, the substituents are alkyl or alkoxy groups of 1-4 carbons, halogens and nitro groups, all of which are stable with most actives, including hypochlorite. An example of the preferred embodiment for a thickening agent with viscous rheology is the paired surfactants of sodium xylene sulfonate and betaine, which provides a viscoelastic thickened system. In a preferred embodiment of the current invention the betaine may range may be from 0.2 to 5 percent by weight of the composition. Generally, the amount of betaine is preferably from about 0.35 to about 3.0 percent by weight of the composition and more preferably from about 1.5 to about 2.5 percent by weight of the composition. In this preferred embodiment of the current invention, the betaine is blended with sodium xylene sulfonate in a range of 0.1 to 5. In this embodiment the amount of sodium xylene sulfonate is preferably from about 0.2 to about 2.0 percent by weight of the composition and more preferably from about 0.3 to about 1.0 percent by weight of the composition.

Surfactant thickened systems can also utilize fatty acid soap or amine oxide surfactants. In this embodiment the preferred invention, the amount of fatty acid soap or amine oxide surfactants is an amount ranging is present in an amount ranging from 0.2 to 5 percent by weight. Generally, the amount of fatty acid soap or amine oxide surfactants is preferably from about 0.3 to about 3.0 percent by weight of the inventive composition and more preferably from about 0.5 to about 1.5 percent by weight of the inventive composition.

Another surfactant-thickened system is based on U.S. Pat. No. 5,731,276, which is assigned to the assignee of this invention herein, the disclosures of which are incorporated herein by reference. In this embodiment the surfactant thickened system comprises a hypochlorite bleach, a colloidal thickener, at least one surfactant that is effective at providing cleaning activity and, in association with the colloidal thickener, thickening. The composition based on U.S. Pat. No. 5,731,276 also includes an electrolyte/buffer, which is effective to promote an environment in which the thickener and the surfactant associate to provide proper thickening. The composition based on U.S. Pat. No. 5,731,276 also has a targeted hypochlorite bleach content of 1.5 percent by weight, which is much less than commercial hypochlorite bleaches, which are typically 6 percent by weight strength for "Ultra" bleaches, providing for safe but effective treatment of surfaces.

Polymer thickeners, like polyacrylates, may also be used as thickening agents. Preferred compositions from may contain polymers in a range of 0.1 to 5 percent by weight. In this embodiment the amount of polymer thickeners is preferably from about 0.3 to about 3.0 percent by weight of the inventive cleaning composition and more preferably from about 1.0 to about 2.0 percent by weight of the cleaning composition.

Clay thickeners, like laponite, may also be used as thickening agents from about 0.5 to about 5.0 percent by weight of the cleaning composition and more preferably from about 2.5 to about 3.5 percent by weight of the cleaning composition.

Additives

The composition of the present invention can be formulated to include additives, such as pH adjustors, buffers, fragrances, coloring agents, whiteners, brighteners, builders, stabilizers, chelating agents, solvents, preservatives and the like, which enhance performance, stability or aesthetic appeal of the compositions. Such components can be included according to compatibility, desirability, convenience, or other factors. Generally, all of these additives are also selected with the characteristic of being compatible with other actives, and if an oxidizing agent is present, being stable and/or resistant to the oxidizing agent employed.

pH Adjustors

The compositions of the present invention may comprise an acid or alkalinity source to adjust the pH of the compositions according to the present invention.

Suitable acid sources for use herein include the mineral acids, such as hydrochloric acid, nitric acid, phosphoric acid and sulfuric acids. These are added in the required amount to lower the composition pH to the desired range.

Suitable alkalinity sources for use herein are the caustic alkalis, such as sodium hydroxide, potassium hydroxide and/ or lithium hydroxide, and/or the alkali metal oxides such, as sodium and/or potassium oxide or mixtures thereof. A preferred alkalinity source is a caustic alkali, more preferably sodium hydroxide and/or potassium hydroxide. These are added in the required amount to raise the composition pH to the desired range.

Other suitable alkalinity sources include ammonia, ammonium carbonate and hydrogen carbonate.

Preferred compositions herein may comprise up to 10 percent by weight, preferably of from 0.04 to 5 percent by weight, and more preferably of from 0.1 to 2 by weight of the total composition of said alkalinity source.

pH Buffering Components

The compositions according to the present invention may optionally comprise a further pH buffering component, in addition to the pH buffering action that the borate may have. Particularly useful are alkali metal salts of carbonates, polycarbonates, sesquicarbonates, silicates, polysilicates, phosphonates, stannates, aluminates or mixtures thereof. The preferred alkali metal salts to be used herein are sodium and potassium salts. Particularly preferred are alkali metal salts of carbonate. The preferred alkali metal salt of carbonate is sodium carbonate.

Additionally, if the cleaner includes a hypochlorite source, a high pH is important for maintaining hypochlorite stability. Examples of suitable buffers include the alkali metal silicates, metasilicates, polysilicates, carbonates, bicarbonates, sesquicarbonates, hydroxides, orthophosphates, metaphosphates, pyrophosphates, polyphosphates and mixtures of the same.

The compositions of the present invention may comprise up to 10%, preferably from 0.01% to 5% and more preferably from 0.02% to 3% by weight of the total composition of a pH buffering component.

Fragrances

Fragrances, such as those commercially available from International Flavors and Fragrance, Inc., may be included in any of the compositions produced according to the embodiments described herein. Suitable fragrances may take the form of fragrance oils. A fragrance or mixture of fragrances may be present in an amount of from about 0.01 to about 2.0 percent by weight of the composition. Preferably, a fragrance or mixture of fragrances is present in am amount from about 0.1 to about 1 percent by weight of the inventive cleaning composition.

When an oxidizing agent is present, particularly if the oxidizing agent is a halogen bleach, such as a hypohalite, fragrance additives are preferably included in a bleach composition, which includes the pH adjustor and is preferably maintained at a pH appropriate for fragrance stability.

Whiteners

Whiteners may optionally be included in small amounts. Titanium dioxide and other neutrally colored inorganic oxides such as alumina (aluminum oxide), zinc oxide and magnesium oxide, are examples of widely used whiteners that may be incorporated in the compositions produced according to the present invention as a whitening agent for aesthetic purposes. Most preferred are whiteners of sufficiently small particle size to enable easy and stable dispersing into the thickened compositions, such particle sizes being suitable are those that resist the effect of segregation or precipitation over long storage times in the compositions.

Brighteners

The compositions according to the present invention may also comprise a brightener as an optional ingredient. Naturally, for the purpose of the invention, the brightener has to be stable in the presence of the other compositional ingredients used. The brighteners may be desired herein to further enhance the whiteness performance of the cleaning compositions herein.

Brighteners are compounds, which have the ability to fluoresce by absorbing ultraviolet wave-lengths of light and re-emitting visible light. Brighteners, also referred to as fluorescent whitening agent (FWA), have been extensively described in the art, see for instance "Fluorescent Whitening Agents" by A. K. Sarkar, published by MERROW, especially page 71-72.

Commercial optical brighteners, which may be useful in the present invention, can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Examples of optical brighteners, which are useful in the present compositions, are those identified in U.S. Pat. No. 4,790,856. These brighteners include the PHORWHITE™ series of brighteners from Verona. Other brighteners disclosed in this reference include: TINOPAL-UNPA®, TINOPAL CBS® and TINOPAL 5BM® available from Ciba-Geigy; ARTIC WHITE CC® and ARTIC WHITE CWD®; the 2-(4-styryl-phenyl)-2H-naptho[1,2-d]triazoles; 4,4'-bis(1,2,3-triazol-2-yl)-stilbenes; 4,4'-bis(styryl)biphenyls; and the aminocoumarins.

Specific examples of brighteners useful herein include 4-methyl-7-diethyl-amino coumarin; 1,2-bis(-benzimidazol-2-yl)ethylene; 1,3-diphenyl-pyrazolines; 2,5-bis(benzoxazol-2-yl)thiophene; 2-styryl-naptho-[1,2-d]oxazole; 2-(stilbene-4-yl)-2H-naphtho[1,2-d]triazole, 3-phenyl-7-(isoindolinyl)coumarin; 3-methyl-7-(isoindolinyl)coumarin; 3-chloro-7-(isoindolinyl)coumarin; 4-(isoindolinyl)-4'-methylstilbene; 4-(isoindolinyl)-4'-methoxystilbene; sodium 4-(isoindolinyl)-4'-stilbenesulfonate; 4-(isoindolinyl)-4'-phenylstilbene; 4-(isoindolinyl)-3-methoxy-4'-methylstilbene; 4-(2-chloroisoindolinyl)-4'-(2-methylisoindolinyl)-2,2'-stilbenedisosulfonic acid; disodium 4,4'-diisoindolinyl-2,2'-stilbene disulfonate; 4,4'-diisoindolinyl-2,2'-stilbenedisulfonamide; disodium 4,4'-(7,8-dichloro-1-isoindolinyl)2,2-stilbenedisulfonate; disodium 4,4'-(7-chloro-1-isoindolinyl)2,2-stilbenedisulfonate; disodium 4,4'-(6-Isopropoxy-1-isoindolinyl)2,2-stilbenedisulfonate; disodium 4,4'-(7,8-diisopropyl-1-isoindolinyl)2,2-stilbenedisulfonate; disodium 4,4'-(7-butoxy-1-isoindolinyl)2,2-stilbenedisulfonate; disodium 4,4'-(6-trifluoromethyl-1-isoindolinyl)2,2-stilbenedisulfonate; disodium 4,4'-[6-(1,4,7-trioxanonyl)-1-isoindolinyl)]2,2-stilbenedisulfonate; disodium 4,4'-(7-methoxymethyl-1-isoindolinyl)2,2-stilbenedisulfonate; disodium 4,4'-(6-phenyl-1-isoindolinyl)2,2-stilbenedisulfonate; disodium 4,4'-(6-naphthyl-1-isoindolinyl)2,2-stilbenedisulfonate; disodium 4,4'-(6-methylsulfonyl-1-isoindolinyl)2,2-stilbenedisulfonate; disodium 4,4'-(7-cyano-1-isoindolinyl)2,2-stilbenedisulfonate; and disodium 4,4'-[7-(1,2,3-trihydroxypropyl)-1-isoindolinyl)]2,2-stilbenedisulfonate; disodium 4-isoindolinyl-4'-ethoxy-2,2'-stilbenedisulfonate; disodium 4-isoindolinyl-4'-methoxy-2,2'-stilbenedisulfonate; disodium 4-isoindolinyl-4'-ethoxy-2,2'-stilbenedisulfonamide; disodium 4-isoindolinyl-4'-methyl-2,2'-stilbenedisulfonamide; 4,4'-bis(4-phenyl-2H-1,2,3-triazol-2-yl)-2,2'-stilbenedisulfonic acid and mixture thereof.

One of the functionally equivalent derivative salts of 4,4'-bis(4-phenyl-2H-1,2,3-triazol-2-yl)-2,2'-stilbenedisulfonic acid, namely its sodium salt is available from Mobay Chemical Corporation, a subsidiary of Bayer AG under the name PHORWITE® CAN. The amine salt is available from Mobay under the name PHORWITE® CL solution. The potassium salt is available under the name PHORWITE® BHC 766.

Other substituted stilbene 2,2'-disulfonic acid derivatives also include 4-4'-bis(2-2' styryl sulfonate)biphenyl, commercially available from Ciba-Geigy under the trade name BRIGHTENER 49™ or other hydrophilic brighteners, for example BRIGHTENER 3™ or BRIGHTENER 47™, also commercially available from Ciba-Geigy.

Further specific examples of brighteners useful in the present invention include the polycyclic oxazole derivatives such as benzo-oxazole derivatives, or mixtures thereof and particularly preferred herein the benzo-oxazole derivatives. An example of such a brightener is benzoxazole-2,2'-bis (thiophenaldyl), commercially available from Ciba-Geigy under the trade name TINOPAL SOP®. This brightener is almost insoluble in water, i.e., it has a solubility being lower than 1 gram per liter. Another example of such a brightener is bis(sulfobenzofuranyl)biphenyl, commercially available from Ciba-Geigy under the trade name TINOPAL PLC®. Another example of a suitable brightener is CBS-X™, a distilbene type brightener, commercially available from Ciba-Geigy.

Builders

Suitable builders may be optionally included in the composition. Such builders include but are not limited to carbonates, phosphates and pyrophosphates, which are known to reduce the concentration of free alkali metal ions in aqueous solution. Certain suitable pH-adjusting agents, such as carbonates, phosphates, phosphonates, polyacrylates and pyrophosphates also function as builders. Typical builders, which do not also function as pH-adjusting agents, include sodium and potassium tripolyphosphate and sodium or potassium hexametaphosphate. These builders ay also function as electrolytes.

Solvents

Various solvents may also be included in the composition. For example, suitable solvents include alcohols, glycols and glycol ethers. Lower alkyl alcohols such as methanol, ethanol and various isomers of the propanols, such as iso-propanol and n-propanol, and various isomers of the butanols are suitable. Glycols and glycol ether solvents are preferred as generally being less odorous, less volatile and more compatible with other cleaning components than are alcohol solvents. Diethyleneglycol and ethylene glycol n-butyl ether are also suitable.

Further by way of example, suitable solvents for use herein include propylene glycol t-butyl ether and propylene glycol n-butyl ether. If mixtures of solvents are used, the amounts and ratios of such solvents used are important in determining the optimum cleaning and streak/film performances of the inventive composition. It is preferred to limit the total amount of solvent to no more than 50 percent by weight, more preferably no more than 25 percent by weight, and most preferably, no more than 15 percent by weight, of the composition. A preferred range for the total amount of solvent is about 1 to 15 percent by weight of the composition, although in some of the compositions of this invention, solvent may be omitted. If a mixed solvent system of alkanol/glycol ether is used, the ratio of alkanol to alkylene glycol ether should be about 1:20 to 20:1, more preferably about 1:10 to 10:1, and most preferably about 1:5 to 5:1.

Other, less water soluble or dispersible organic solvents may also be used herein, although in a high water formulation, there may be a need for a further dispersant (e.g., hydrotrope or other emulsifier). These less water soluble or dispersible organic solvents include those commonly used as constituents for proprietary fragrance blends, such as terpene derivatives. The terpene derivatives herein include terpene hydrocarbons with a functional group. Effective terpenes with a functional group include, but are not limited to, alcohols, ethers, esters, aldehydes and ketones.

Representative examples for each of the above classes of terpenes with functional groups include but are not limited to the following: (1) terpene alcohols, including, for example, verbenol, transpinocarveol, cis-2-pinanol, nopol, isoborneol, carbeol, piperitol, thymol, -terpineol, terpinen-4-ol, menthol, 1,8-terpin, dihydro-terpineol, nerol, geraniol, linalool, citronellol, hydroxycitronellol, 3,7-dimethyl octanol, dihydro-myrcenol, -terpineol, tetrahydro-alloocimenol and perillalcohol; (2) terpene ethers and esters, including, for example, 1,8-cineole, 1,4-cineole, isobornyl methylether, rose pyran, -terpinyl methyl ether, menthofuran, trans-anethole, methyl chavicol, allocimene diepoxide, limonene monoepoxide, iso-bornyl acetate, nopyl acetate, -terpinyl acetate, linalyl acetate, geranyl acetate, citronellyl acetate, dihydroterpinyl acetate and neryl acetate; and (3) terpene aldehydes and ketones, including, for example, myrtenal, campholenic aldehyde, perillaldehyde, citronellal, citral, hydroxy citronellal, camphor, verbenone, carvenone, dihyrocarvone, carvone, piperitone, menthone, geranyl acetone, pseudo-ionone, -ionone, -ionone, iso-pseudo-methyl ionone, normal-pseudo-methyl ionone, iso-methyl ionone and normal-methyl ionone. Terpene hydrocarbons with functional groups which appear suitable for use in the present invention are discussed in substantially greater detail by Simonsen and Ross, The Terpenes, Volumes I-V, Cambridge University Press, 2nd Ed., 1947 (incorporated herein by reference thereto). See also, the commonly assigned U.S. Pat. No. 5,279,758, by Choy, incorporated herein in its entirety by this reference.

Stabilizing Agents

The compositions according to the present invention may further comprise a stabilizing agent, preferably a radical scavenger, a chelating agent or a mixture thereof.

Highly preferred stabilizing agents are radical scavengers alone or in combination with a chelating agent. Suitable radical scavengers for use herein include aromatic radical scavengers comprising an unsaturated ring system of from 3 to 20, preferably of from 3 to 18 and more preferably of from 5 to 14 carbon atoms and having a double bond set comprising a total of 4n+2 electrons, wherein n is an integer of from 0 to 4, preferably of from 1 to 3. Indeed said aromatic radical scavengers include benzene derivatives, naphthalene derivatives, annulene derivatives, cyclopentadiene derivatives, cyclopropene derivatives and the like, especially aryl carboxylates and/or aryl sulfonates.

Particularly suitable radical scavengers (aryl carboxylates, aryl sulphonate and derivatives thereof) for use in the present invention include pyromellitic acid, phthalic acid; sulfophthalic acid; other mono-substituted phthalic acids; di-substituted benzoic acids; alkyl-, chloro-, bromo-, sulfo-, nitro- and alkoxy-benzoic acids, anisic acid and substituted sulfonic acids. Highly preferred examples of the radical scavengers useful in the present invention are benzoic acid, toluic acid, 4-toluene sulfonic acid, 3-nitro benzoic acid, n-octyl benzoic acid, n-octyl sulfonic acid, anisic acid or mixtures thereof.

While the radical scavengers described above are the acidic forms of these species, i.e. protonated, it is intended that the present invention also covers the salt derivatives of these species. Suitable salt derivatives include salts of an alkali metal, preferably sodium or potassium. In fact, where the pH of the compositions of the present invention is in the alkaline range, the radical scavengers of the present invention exist primarily as the ionized salt in the aqueous composition herein. The anhydrous derivatives of certain species described herein above can also be used: in the present invention, e.g., pyromellitic dianhydride, phthalic anhydride, sulphthalic anhydride and the like.

Suitable chelating agents for use herein may be any of those known to those skilled in the art such as the ones selected from the group comprising phosphonate chelating agents, phosphate chelating agents, polyfunctionally-substituted aromatic chelating agents, ethylenediamine N,N'-disuccinic acids, or mixtures thereof. Preferably, the chelating agent is selected from a number of known agents, which are effective at chelating heavy metal ions. The chelating agent should be resistant to hydrolysis and rapid oxidation by oxidants.

Examples of some preferred chelating agents include, but are not limited to, aminopolyphosphonate, which is commercially available under the trademark DEQUEST® from Monsanto Company. Examples thereof are DEQUEST® 2000, 2041 and 2060. (See also Bossu U.S. Pat. No. 4,473,507, column 12, line 63 through column 13, line 22, incorporated herein by reference.) A polyphosphonate, such as DEQUEST® 2010, is also suitable for use.

Other chelating agents, such as ethylenediaminetetraacetic acid (EDTA) and nitrilotriacetic acid (NTA) may also be suitable for use. Still other chelating agents include, but are not limited to, propylenediaminetetraacetates, such as Hampshire 1,3 PDTA, from W. R. Grace, and Chel DTPA 100#F, from Ciba Geigy A. G. Mixtures of any of the foregoing chelating agents may be suitable.

Water

It should be briefly noted that the main ingredient in the inventive compositions is water, preferably softened, distilled or deionized water. Water provides the continuous liquid phase into which the other ingredients are added to be dissolved/dispersed. This provides the unique fluid properties of the invention. The amount of water present generally exceeds 30% and, indeed, can be as high as 98%, although generally, it is present in a quantity sufficient (q.s.) to provide the appropriate rheological characteristics desired of the inventive compositions.

Viscosity and Wicking Rates

In the present invention the combination of composition thickness (viscosity) and dispensing orifice size plays a critical role in the ability to control the application of the product. Different product viscosities were tested with a 0.06-inch orifice size and were found to flow uncontrollably from an applicator, as shown in Table IIA (hypochlorite oxidizing agent) and Table IIB (peroxide bleaching agent).

TABLE IIA

| | Composition (weight % as 100% active) (1) | | | | | | | | |
|---|---|---|---|---|---|---|---|---|---|
| Example | % Bleach (2) Hypochlorite | % NaOH (3) | % SXS (4) | % Cetyl betaine (4) | % Fatty acid soap (5) | % Amine oxide (6) | % Alumina Mono-hydrate (7) | Measured (8) viscosity range (cP) | Acceptable control in dispensing |
| A | 1.40 | 0.90 | | | 1.21 | 1.80 | | 300-1000 spindle 2, 20 rpm | No |
| B | 1.10 | 0.44 | | | 0.76 | 0.88 | 1.90 | 12,000 + 3000 spindle 4, 5 rpm | Yes |
| C | 7.14 | 0.725 | 0.25 | 0.25 | | | | <100 cP | No |
| D | 1.40 | 0.90 | | | 1.21 | 1.80 | | 300-1000 spindle 2, 20 rpm | No |
| E | 2.30 | 0.55 | | | | 0.50 | | <100 cP | No |
| F | 1.40 | 0.30 | | | 1.11 | 0.90 | 4.30 | 12,000 + 3000 spindle 4, 5 rpm | Yes |
| G | 2.00 | 0.65 | | | 0.50 | 1.29 | | 700-2000 spindle 2, 10 rpm | No |
| H | 5.80 | 1.85 | 0.35 | 0.50 | | | | <100 cP | No |
| I | 1.40 | 0.30 | | | 1.11 | 0.90 | 4.65 | 16,000 + 3000 spindle 4, 5 rpm | Yes |
| J | 1.50 | 0.50 | 0.68 | 1.93 | | | | 10,000 cP | Yes |
| K | 1.50 | 0.50 | | | | 1.20 | | 10,000 cP | Yes |
| L | 6 | 0.015 | | | | | | <100 cP | No |

Notes to Table IIA:
cP = centipoise
rpm = revolutions per minute

TABLE IIB

| | Composition (weight % as 100% active) (1) | | | | | | | | |
|---|---|---|---|---|---|---|---|---|---|
| Example | % SXS (4) | % Cetyl betaine (4) | % Hydrogen peroxide (9) | % Fatty acid soap (6) | % Amine oxide (6) | % Alumina Mono-hydrate (7) | pH adjuster Sulfuric Acid (10) | pH adjuster Sodium Hydroxide (3) | Ionic Strength Adjuster (11) |
| M | 0.68 | 1.93 | | | | | | 0.3 | 1.18 |
| N | | | | 0.76 | 0.88 | 1.90 | | 0.4 | 0.86 |
| O | | | 2.0 | 0.76 | 0.88 | 1.90 | 0.01 | | 0.86 |
| P | | | 3.0 | 1.11 | 0.90 | 4.30 | 0.02 | | 1.10 |

TABLE IIB-continued

| Example | % SXS (4) | % Cetyl betaine (4) | % Hydrogen peroxide (9) | % Fatty acid soap (6) | % Amine oxide (6) | % Alumina Mono-hydrate (7) | pH adjuster Sulfuric Acid (10) | pH adjuster Sodium Hydroxide (3) | Ionic Strength Adjuster (11) |
|---|---|---|---|---|---|---|---|---|---|
| | Composition (weight % as 100% active) (1) | | | | | | | | |
| Q | | | 3.5 | 1.11 | 0.90 | 4.65 | 0.02 | | 1.10 |
| R | 0.68 | 1.93 | 3.5 | | | | 0.005 | | 1.18 |

Notes to Tables IIA and IIB:
(1) Water added to achieve 100% weight, unless stated otherwise
(2) Sodium hypochlorite, 6% active stock solution from Clorox plants.
(3) Sodium hydroxide, 50% from J T Baker
(4) Sodium Xylene Sulfonate/Cetyl Betaine blend from Stepan Co. about 16% active
(5) preblend made from Lauric Acid (Henkel/Cognis), sodium hydroxide J T Baker 50% active, water.
(6) Lauryl and Cetyl dimethylamine oxide, (30% active) from Stepan (Ammonyx LO/CO)
(7) Alumina monohydrate, 100% active, available from Sasol-Alco World Chemical
(8) Measured using Brookfield model DVII viscometer with spindle and speed noted.
(9) Sodium peroxide, 30% from Degussa, cosmetic grade.
(10) Sulfuric Acid, 10% (v/v) Reagent Grade, J T Baker. Sufficient to achieve composition pH of about 3.5.
(11) Soluble salt of alkali metal or alkaline earth metal. Sodium chloride, 100% active from Aldrich Chemical.

In a test to monitor product wicking, 100 microliters of product is applied to form an initial 8 millimeters (mm) diameter circular drop. After 15 minutes, the diameter of the drop is measured on 3 different representative surfaces, including a typical textile fabric, unglazed (bisque) tile and plastic (polyethylene weigh boat).

Preferred compositions will not wick as much as other products, as shown in Table III.

TABLE III

| Product | Viscosity (1) | Surface: Fabric (2) | Surface: Bisque tile (3) | Surface: Polyethylene weigh boat (4) |
|---|---|---|---|---|
| "Spray 'n Wash for White Laundry" (hereinafter "SnW") | 6,300 cP | 23 mm | 15 mm | 25 mm |
| Inventive composition | 10,900 cP | 13 mm | 8 mm | 8 mm |
| Inventive composition | 16,600 cP | 17 mm | 8 mm | 8 mm |

Notes:
mm = millimeter
cP = centipoise
(1) measured on a Brookfield DVII viscometer spindle 4 @ 5 rpm
(2) fabric is 100% mercerized cotton broadcloth which is green and hypochlorite-sensitive from Pago. The diameter was based on where the hypochlorite damage was seen to occur due to composition wicking.
(3) Bisque tile, unglazed, purchased from Dal-Tile (this mimics unsealed grout)
(4) Hydrophobic plastic weigh boat, available from major laboratory supply firms to represent hydrophobic surfaces like tile.

In a preferred embodiment the applicator fits comfortably in hand in sizes containing from about 1.5 to about 4 ounces of thickened cleaning composition. It may have one or preferably, more than one applicator tip with one or preferably, more than one orifice to dispense product. For a smaller applicator tip, a single orifice may be preferred. For large applicator tips, multiple orifices may be preferred. The orifices may range from about 0.08 $mm^2$ to about 4 $mm^2$ to allow application of a precise bead of product. The opening of the tip may be long and narrow to ensure delivery of product onto a specific small area. A broader tip may be used, preferably made from a bleach stable flexible material with a textured surface or bristles, such a material being a silicone or fluorine-containing polymer. The flexible tip will contour to surfaces to ensure product treatment into all areas of an uneven or rough stained area. Either tip can be used on either a soft surface, such as fabric, or hard surface. In addition to applicators with a single bore orifice, "Dabber" style applicators have been used successfully. These applicators feature a small head (18 mm) covered with bleach stable material (such as polyester fleece) or a head of a conformable bleach stable polymer, such as silicon rubber, with multiple underlying orifices. Another preferred embodiment of the applicator is based on JP 09286200, entitled "Paste Vessel", the disclosures of which are incorporated herein by reference.

The applicator itself may have one or more chambers in order to deliver flexibility to a user to dispense one or more cleaning products. A multiple chambered product may hold incompatible ingredients to be delivered simultaneously out of a common orifice or delivered adjacently out of two close, but separate orifices to approximately the same external point. Some examples of ingredients that could be employed in a two-chambered applicator are peroxygen bleach in one chamber and peroxide activator in the second. Another example is a brightener or FWA (fluorescent whitening agent) in the first chamber and hypochlorite bleach in the second chamber. Another example is a bleach source like hydrogen peroxide on one side and an enzyme or enzyme mixture in the second. The applicator may have multiple tips to provide convenience and different benefits to the consumer. Each of these tips could have an opening that may be closed independently. The tips may optionally include an overcap, which may optionally have a clearing pin that effectively prevents the product residue from clogging the orifice when the applicator is not in use.

The data on wicking diameter and the wicking rates based on 15 minutes of contact time and an initial product drop size of 8 mm are shown on Tables IV A and IV B below TABLES IV A and IV B

| Product | viscosity | wicking diameter on surfaces: fabric | wicking diameter on surfaces: bisque tile | wicking diameter on surfaces: weigh boat |
|---|---|---|---|---|
| SnW | 6,300 cps | 23 mm | 15 mm | 25 mm |
| Inventive composition | 10,900 cps | 13 mm | 8 mm | 8 mm |

TABLES IV A and IV B-continued

| Inventive composition | 16,600 cps | 17 mm | 8 mm | 8 mm |
|---|---|---|---|---|
| | | wicking rates mm/min on surfaces | | |
| Product | viscosity | fabric | bisque tile | weigh boat |
| SnW | 6,300 cps | 1.00 | 0.47 | 1.13 |
| Inventive composition | 10,900 cps | 0.33 | 0.00 | 0.00 |
| Inventive composition | 16,600 cps | 0.60 | 0.00 | 0.00 |

The above examples and illustrations are meant only to describe certain embodiments of the current invention, and are not meant to limit or in any manner restrict the scope of the current invention.

What is claimed is:

1. A device for delivering a thickened cleaning composition comprising:

a. an applicator;

b. wherein said applicator comprises:

i. a chamber containing a thickened cleaning composition comprising an oxidizing agent selected from the group consisting of a hypohalite, a hypohalite generator, a peroxygen bleach, and combinations thereof; and ii. at least one orifice for dispensing said thickened cleaning composition;

c. wherein said thickened cleaning composition has a viscosity greater than 2000 cP as measured using a Brookfield model DVII viscometer with spindle 2 at 10 rpm; and d. wherein said thickened cleaning composition has a wicking rate after 15 mm of between 0 and 1.0 mm/min on 100% mercerized cotton broadcloth fabric.

2. The device of claim 1, wherein said thickened cleaning composition comprises hypochlorite.

3. The device of claim 1, wherein said viscosity is greater than 3000 cP.

4. The device of claim 1, wherein said viscosity is greater than 4000 cP.

5. The device of claim 1, wherein said viscosity is greater than 10,000 cP.

6. The device of claim 1, wherein said thickened cleaning composition comprises a peroxygen bleach.

7. The device of claim 1, wherein said device comprises an additional chamber.

8. The device of claim 7, wherein said additional chamber comprises a chemical composition comprising a bleach activator.

9. A device for delivering a composition comprising an applicator comprising:

a. a chamber containing a composition comprising an oxidizing agent selected from the group consisting of a hypohalite, a peroxygen bleach, a peroxide containing material, a peracid, hydrogen peroxide, an inorganic peroxide, and combinations thereof; and b. at least one orifice for dispensing said composition;

c. wherein said composition has a wicking rate after 15 mm. of between 0 and 1.0 mm/min. on 100% mercerized cotton broadcloth fabric.

10. The device of claim 9, wherein said composition has a viscosity greater than 2000 cP as measured using a Brookfield model DVII viscometer with spindle 2 at 10 rpm.

11. The device of claim 9, wherein said composition additionally comprises a bleach activator.

12. The device of claim 9, wherein said oxidizing agent is an inorganic peroxide.

13. The device of claim 9, wherein said oxidizing agent is a persulfate salt.

14. The device of claim 9, wherein said oxidizing agent is a preformed peroxyacid.

15. The device of claim 9, wherein said oxidizing agent is an organic peroxide selected from the group consisting of diacyl peroxides, dialkyl peroxides, hydroperoxides and mixtures thereof.

* * * * *